United States Patent [19]

Schnabel et al.

[11] Patent Number: 4,566,925

[45] Date of Patent: Jan. 28, 1986

[54] METHOD OF MOUNTING A METAL BAND ABOUT A COVER PLATE

[75] Inventors: Jürgen Schnabel; Jürgen Plath, both of Wiesbaden, Fed. Rep. of Germany

[73] Assignee: Didier-Werke AG, Wiesbaden, Fed. Rep. of Germany

[21] Appl. No.: 575,937

[22] Filed: Jan. 31, 1984

[30] Foreign Application Priority Data

Feb. 12, 1983 [DE] Fed. Rep. of Germany ..... 3304938

[51] Int. Cl.[4] ..... B32B 31/00

[52] U.S. Cl. ..... 156/86; 29/447; 29/458; 156/294; 222/600; 266/271

[58] Field of Search ..... 29/447, 458, 800; 156/294, 86, 165; 266/272, 236, 271; 222/600

[56] References Cited

U.S. PATENT DOCUMENTS

| | | | |
|---|---|---|---|
| 2,751,236 | 6/1956 | Wyatt | 156/86 X |
| 3,113,482 | 12/1963 | Hirsch | 156/294 X |
| 3,211,598 | 10/1965 | O'Brien, Jr. | 156/86 |
| 3,349,478 | 10/1967 | De Jean | 156/86 X |
| 3,371,413 | 3/1968 | Rundle | 29/447 X |
| 3,685,705 | 8/1972 | Shapland | 222/600 |
| 3,937,641 | 2/1976 | Kushner et al. | 156/294 X |
| 3,945,874 | 3/1976 | Backstrom et al. | 29/447 X |
| 3,970,283 | 7/1976 | Hind | 222/600 X |
| 4,256,348 | 3/1981 | Lester et al. | 29/447 X |
| 4,265,379 | 5/1981 | Meier | 222/600 |
| 4,270,380 | 6/1981 | Gulati et al. | 29/447 X |
| 4,376,501 | 3/1983 | Hafner et al. | 222/600 |

FOREIGN PATENT DOCUMENTS

| | | | |
|---|---|---|---|
| 1311323 | 10/1962 | France | 29/447 |

*Primary Examiner*—Charlie T. Moon

*Attorney, Agent, or Firm*—Wenderoth, Lind & Ponack

[57] ABSTRACT

A metal band is mounted about the periphery of a cover plate, particularly a ceramic sliding plate for use with a sliding gate nozzle for controlling the discharge of molten metal from a vessel, such that the cover plate can be mounted on a supporting frame by means of releasable clamps acting on the metal band. The peripheral surface of the cover plate is covered with a layer of thermally setting mortar, and a heated steel ring is positioned around the mortar layer. The steel ring is cooled, such that the steel ring shrinks about the mortar layer, while the mortar layer is heated and thereby set, such that the cooled steel ring is bonded about the peripheral surface by the mortar layer. Alternatively, the cover plate may be positioned within a mold having a peripheral rim such that there is defined between the mold rim and the peripheral surface a space surrounding the peripheral surface. This space may be filled with a molten non-ferrous metal or gray cast iron which is solidified, thereby forming a band fixed to the peripheral surface.

2 Claims, 2 Drawing Figures

METHOD OF MOUNTING A METAL BAND ABOUT A COVER PLATE

BACKGROUND OF THE INVENTION

The present invention relates to a method of mounting a metal band about a cover plate and to an assembly formed by such method.

The present invention more particularly is directed to such a method for forming such assembly for use as a sliding plate with a sliding gate nozzle for controlling the discharge of molten metal from a vessel, and whereby the plate can be mounted on a supporting frame by means of releasable clamps acting on the metal band mounted about the periphery of the sliding plate, for example a ceramic sliding plate.

The prior art includes a number of such assemblies and methods for the formation thereof, and particularly for use in a sliding gate nozzle arrangement. It is necessary to provide a metal band about the ceramic cover plate, since the releasable clamps for mounting the cover plate would destroy the ceramic cover plate if applied directly thereto. However, in the past the encasing of the cover plate with a metal band has required an expensive reworking of the periphery of the plates in order to avoid stresses due to differing shrinkage forces during use of the assembly, i.e. during use to discharge molten metal from a vessel.

SUMMARY OF THE INVENTION

With the above discussion in mind, it is an object of the present invention to provide such an assembly and method of formation thereof whereby the cover plate can be encased in a metal band without the requirement of any reworking operations and without generating differing shrinkage forces.

In accordance with one method aspect of the present invention there is provided a method of mounting a metal band about the peripheral surface of a cover plate by covering the peripheral surface with a layer of thermally setting mortar, positioning a heated steel ring, for example a red-hot steel ring, around the mortar layer, and cooling the steel ring, whereby the steel ring shrinks about the mortar layer, while heating and thereby setting the mortar layer, such that the cooled steel ring is bonded about the peripheral surface of the cover plate by the mortar layer. During the cooling of the steel ring, excess mortar between the peripheral surface of the cover plate and the steel ring is squeezed outwardly from opposite ends thereof. At the same time, the heat from the steel ring hardens or sets the mortar layer. In this manner, constant, well defined tension loads are obtained through the entire periphery of the cover plate. Furthermore, even relatively large dimensional differences betweeen individual cover plates are compensated for by the provision of the mortar layer.

In accordance with a specifically preferred aspect of this method, the mortar layer is in the form of a predrawn or preformed mortar strand or web, preferably arranged on a supporting strip. For example, a web of mortar having a desired thickness and width may be prefabricated, for example by a small extrusion press, and then mounted on an oil paper strip. The combination of mortar web and supporting strip then is placed or wrapped around the peripheral surface of the cover plate, impressed thereagainst, and the supporting strip then is removed. By this manner, it is possible to achieve in a simple fashion a uniform distribution of the mortar layer. Preferably, the mortar should have a good plastic consistency. By this method, varying dimensions of the cover plates (particularly $ZrO_2$ cover plates) are compensated for by the use of uniformly dimensioned heat-shrunk metal rings.

In accordance with a further aspect of the method of the present invention, the cover plate is positioned within a mold having a peripheral mold rim, such that there is defined between the mold rim and the peripheral surface of the cover plate a space surrounding the peripheral surface. This space is filled with molten non-ferrous metal or gray cast iron. The non-ferrous metal or gray cast iron then is allowed to solidify, thereby forming a band fixed to the peripheral surface of the cover plate. The cover plate with the band fixed thereto then is removed from the mold. In accordance with a particularly advantageous arrangement of this method, the cover plate is centered within the mold, to thereby generally uniformly dimension the peripheral space, by inserting a centering mandrel of the mold through a discharge opening in the cover plate. In accordance with this method of the present invention, even if complex female dies are employed, the method can be implemented inexpensively without the need for major reworking of the cover plate.

Preferably, a non-ferrous metal having a melting point of approximately 800° C. is utilized. The non-ferrous metal should not soften at temperatures up to at least approximately 400° C., preferably 600° C. In this manner, it is possible to ensure that the cover plate remains perfectly fixed in a supporting frame, even at surface temperatures that can be expected during utilization of the slide gate nozzle.

The invention further comprises as an additional aspect the assemblies resulting from the above methods, particularly an assembly of a ceramic sliding plate having thereabout a metal band and usable with a sliding gate nozzle for controlling the discharge of molten metal from a vessel and which can be mounted on a supporting frame by means of releasable clamps acting on the metal band.

BRIEF DESCRIPTION OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 1:
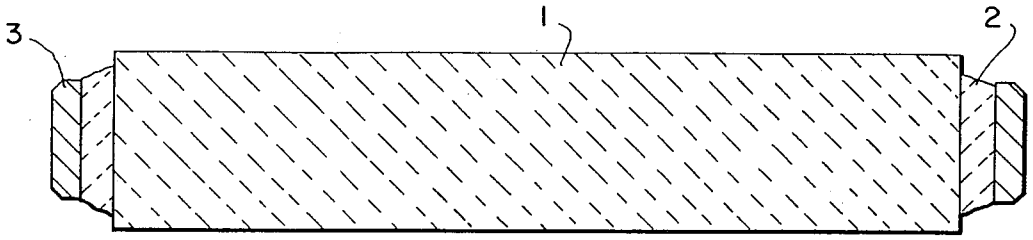
FIG. 1 is a cross-sectional view through one embodiment of an assembly in accordance with the present invention and illustrating the method of formation thereof in accordance with the present invention.

With reference to FIG. 1, an assembly and method in accordance with a first embodiment of the present invention will be described. Thus, a cover plate 1, for example a ceramic sliding plate for use in a sliding plate nozzle, has an outer peripheral surface. This peripheral surface is covered with a layer 2 of thermally setting or thermally bonding mortar. For example, mortar layer 2 may be in the form of a preformed mortar strand or web having good plastic consistency, and such strand or web may be wrapped around the peripheral surface of cover plate 1. Then a heated steel ring 3, for example a red-hot steel ring, is positioned around mortar layer 2. The steel ring then is cooled, whereby the steel ring shrinks internally about the mortar layer. As this shrinkage occurs, excess mortar is squeezed outwardly from opposite ends of the steel ring, i.e. upwardly and downwardly as viewed in FIG. 1. At the same time the mortar layer is heated and thereby set. Generally, it is contemplated that the heat required for setting of the mortar layer may be supplied from the red-hot steel ring. It should be understood that if additional heat is required, then an additional heat source will be provided. As a result, the cooled steel ring is bonded about the peripheral surface of the cover plate 1 by means of the set mortar layer 2.

The mortar layer 2 results in compensation for any variation in the size of a particular cover plate, and for any variation in the peripheral surface thereof. Steel ring 3 may be provided with a predetermined external diameter, as a result of which after shrinking of the steel ring into the mortar, the external diameter of the steel ring will be predetermined. This makes it unnecessary to subject the steel ring to additional machining operations.

It is believed that one of ordinary skill in the art will understand what types of material may be employed for mortar layer 2. It is intended that the mortar be a commercially available refractory mortar that is ready for processing, that can be stored in a cold state for at least six months, and that sets immediately upon being exposed to elevated temperatures. One thermally setting or bonding mortar which may be employed is Resitect 190 KSV, manufactured by Didier-Werke AG of Wiesbaden, West Germany. Such mortar is exemplary only however, and those skilled in the art would realize what other mortars could be employed for given installations.

Figure 2:
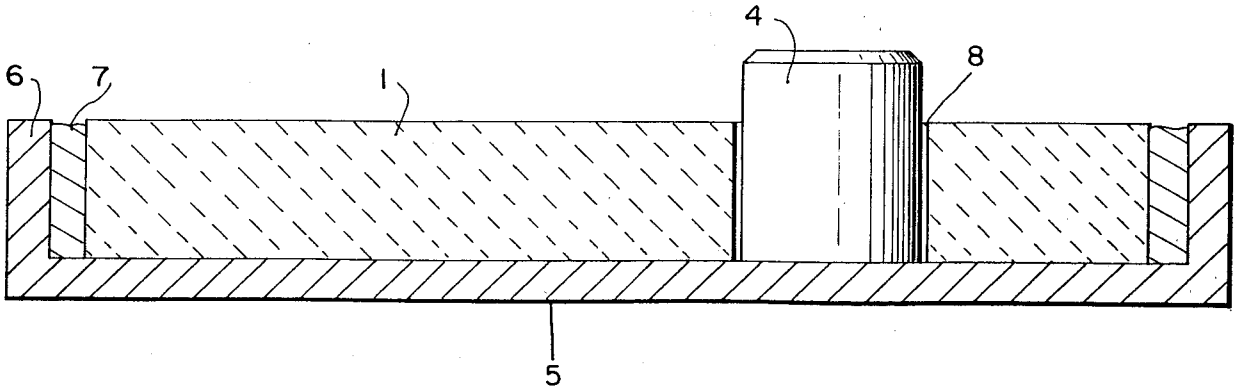
FIG. 2 is a cross-sectional view through an assembly in accordance with a further embodiment of the present invention and illustrating the manner of formation thereof in accordance with the present invention.

FIG. 2 illustrates an assembly and method of formation thereof in accordance with a further embodiment of the present invention. Thus, cover plate 1 is positioned within a mold 5 having a peripheral mold rim 6 of a height at least as great as the thickness of cover plate 1, such that there is defined between mold rim 6 and the peripheral surface of cover plate 1 a space surrounding the peripheral surface. In accordance with a particularly preferred aspect of the present invention, mold 5 has extending therefrom a centering mandrel 4 which may be employed to extend through a discharge opening 8 provided in the cover plate 1 in a known manner. Mandrel 4 thus achieves centering of the cover plate 1 with respect to mold rim 6, thereby achieving uniformity of the space between the mold rim and the peripheral surface. This space is filled with a molten non-ferrous metal or gray cast iron which then is allowed to solidify, thereby forming a metal band 7 fixed to the peripheral surface of cover plate 1. The cover plate 1 with the band 7 fixed thereto then is removed from mold 5, and can be assembled in the slide gate nozzle.

Preferably, a non-ferrous metal having a melting point of approximately 800° C. is employed. The non-ferrous metal should not soften at temperatures up to at least approximately 400° C., preferably 600° C. Those skilled in the art will realize the types of metals which may be employed as the non-ferrous metal. One example is a copper-zinc alloy known as "babbit/bearing" metal.

In both embodiments of the present invention, the metal band formed around and fixed to the peripheral surface of cover plate 1 is mounted thereon without creating differing shrinkage forces during encasing and without requiring any reworking of the peripheral surface of the cover plate or the peripheral surface of the metal band. Even relatively large differences in size of the cover plates are compensated. Accordingly, it is possible to fix with a high degree of reliability the cover plate provided with the steel ring or metal ring in accordance with the present invention in the supporting frame of a slide gate nozzle.

Although the present invention has been described and illustrated with respect to preferred features thereof, it is to be understood that various modifications and changes may be made to the specifically described and illustrated features without departing from the scope of the present invention. Furthermore, it is to be understood that it is intended to be within the scope of the present invention that all features described and/or illustrated herein may be employed in any meaningful combination with respect to each other.

We claim:

1. A method of mounting a metal band about the peripheral surface of a ceramic sliding plate, for use with a sliding gate nozzle for controlling the discharge of molten metal from a vessel, and for ensuring a predetermined outer size of said metal band independent of variations in the size of the periphery of said ceramic sliding plate, and whereby said ceramic sliding plate can be mounted on a supporting frame by means of releasable clamps acting on said metal band, said method comprising:

covering said peripheral surface of said ceramic sliding plate with a layer of thermally setting mortar;

providing a steel ring of said predetermined outer size as said metal band, and heating and thereby expanding said steel ring;

positioning said heated steel ring around said mortar layer covering said peripheral surface of said ceramic sliding plate; and cooling said steel ring, whereby said steel ring shrinks about said mortar layer to said predetermined outer size, while heating and thereby setting said mortar layer, such that said cooled steel ring is bonded about said peripheral surface by said mortar layer.

2. A method as claimed in claim 1, wherein said covering comprises providing a preformed web of said mortar on a supporting strip, wrapping said web about said peripheral surface, and then removing said supporting strip.

* * * * *